US005612722A

United States Patent [19]

Francis et al.

[11] Patent Number: 5,612,722

[45] Date of Patent: Mar. 18, 1997

[54] INK JET PRINTHEAD WIPER HAVING SIDE SURFACES INTERSECTING A TOP SURFACE AT ACUTE ANGLES TO FORM WIPING EDGES AND A SLAT CENTERED IN A BOTTOM SURFACE

[75] Inventors: Monty L. Francis; Edmund H. James, III; Donald N. Spitz, all of Lexington, Ky.

[73] Assignee: Lexmark International, Inc., Lexington, Ky.

[21] Appl. No.: 601,384

[22] Filed: Feb. 14, 1996

Related U.S. Application Data

[63] Continuation of Ser. No. 143,210, Oct. 26, 1993, abandoned.

[51] Int. Cl.[6] ..... B41J 2/165

[52] U.S. Cl. ..... 347/33

[58] Field of Search ..... 347/33; 15/250.48

[56] References Cited

U.S. PATENT DOCUMENTS

| | | | |
|---|---|---|---|
| 3,089,174 | 5/1963 | Bignon | 15/250.48 |
| 3,566,432 | 3/1971 | Quinlan et al. | 15/250.48 |
| 5,103,244 | 4/1992 | Gast et al. | 346/1.1 |
| 5,146,243 | 9/1992 | English et al. | 346/140 R |
| 5,148,203 | 9/1992 | Hirano | 346/140 R |
| 5,151,715 | 9/1992 | Ward et al. | 346/140 R |
| 5,155,497 | 10/1992 | Martin et al. | 346/1.1 |
| 5,182,582 | 1/1993 | Okamura | 347/33 |
| 5,216,449 | 6/1993 | English | 346/140 R |
| 5,381,169 | 1/1995 | Arai et al. | 347/33 |

FOREIGN PATENT DOCUMENTS

| | | | |
|---|---|---|---|
| 2313743 | 10/1974 | Germany | 15/250.48 |
| 3-222754 | 10/1991 | Japan | 347/33 |
| 4-187445 | 7/1992 | Japan | 347/33 |

*Primary Examiner*—Benjamin R. Fuller
*Assistant Examiner*—David Yockey
*Attorney, Agent, or Firm*—John J. McArdle; Ronald K. Aust

[57] ABSTRACT

A wiper for an ink jet printhead comprises a monolithic body having a mounting portion and a head portion, the head portion including a wiper portion and a beam portion for supporting the wiper portion on the mounting portion. The mounting portion has a bottom surface and a slot centered in the bottom surface where the slot extends toward the head portion from the bottom surface and receives a mounting beam that is movable. The wiper is characterized in that the wiper portion has two non-parallel side surfaces which diverge from the beam portion and intersect a flat top surface of the wiper portion at acute angles so as to form two parallel wiping edges which may alternately wipe the printhead as the printhead moves back and forth relative to the wiper. Because the side surfaces of the head portion form angles of less than 90° with the top surface there is less tendency for the head to trap and ride on ink wiped from the printhead. The beam portion has a hole extending through it thus making it more flexible. This permits a harder material to be used in the wiper without causing damage to the printhead. The wiper is normally supported on the opposite side of the plane of record feed from the printhead and may be raised into the path of travel of the printhead. An optional blotter may be provided for absorbing from the wiper the ink which is wiped from the printhead.

6 Claims, 4 Drawing Sheets

INK JET PRINTHEAD WIPER HAVING SIDE SURFACES INTERSECTING A TOP SURFACE AT ACUTE ANGLES TO FORM WIPING EDGES AND A SLAT CENTERED IN A BOTTOM SURFACE

RELATED APPLICATIONS

This application is a continuation of application No. 08/143,210, filed Oct. 26, 1993, now abandoned.

This application discloses and claims subject matter disclosed in the application of Spitz et al. Ser. No. 08/143,328 entitled Maintenance Station For Ink Jet Printhead and filed concurrently herewith. The applications are assigned to the same assignee and the disclosure of the Spitz et al. application is incorporated herein by reference.

FIELD OF THE INVENTION

The present invention relates to a maintenance station for cleaning the nozzle surface of an ink jet printhead, and more particularly to an improved wiper which provides more efficient removal of ink and accumulated foreign matter from the nozzle surface.

BACKGROUND OF THE INVENTION

The prior art recognizes the need for cleaning the nozzle surface of an ink jet printer to remove accumulations of ink and foreign matter, primarily paper fibers, dust and accumulated ink around the nozzle. Such accumulations may clog the very small nozzles through which ink is ejected onto a record, or otherwise affect the dispersal of the ink. Therefore, it has become standard practice to provide some form of wiper for wiping the nozzle surface at intervals during printing and when the printhead is "parked" after printing has been completed.

Two conflicting considerations enter into the design of a wiper. The wiper should be made as hard and wear resistant as possible so that it will not require frequent replacement over the life of the printer. On the other hand, the wiper should be flexible and not so hard as to cause wear of the nozzle surface since the electrical connections leading to the components for causing ejection of the ink are located in the printhead surface being wiped.

An early form of wiper consisted of a generally rectangular beam of elastomeric material located in a maintenance station positioned at one side of the record feed path and extending into the path traversed by the nozzle surface so that the wiper wiped the surface as the printhead moved into, or out of, the maintenance station. A wiper of this type is not efficient in wiping a nozzle surface. The wiping beam tends to accumulate ink between a side of the beam and the nozzle surface, and then rides onto the accumulation so as to leave a thin layer of ink on the surface just wiped.

The problem with the rectangular beam wiper is recognized in U.S. Pat. No. 5,151,715 which attempts to solve the problem by providing two parallel generally rectangular beams, the theory being that the second beam will wipe from the nozzle surface the thin layer of ink left by the first beam. The patent also recognizes that a wiping beam may be made of a harder material and still not cause wear of a nozzle surface if the base portion of the beam is provided with a slot extending through it. U.S. Pat. No. 5,155,497 teaches that the wiper may be mounted for movement into and out of the path traversed by the nozzle surface.

While the wiper disclosed in the aforementioned patents improves wiping efficiency, it is a rather complex structure making it difficult to obtain uniform characteristics among mass produced wipers.

SUMMARY OF THE INVENTION

An object of the present invention is to provide a wiper for wiping an ink jet printhead, the wiper being simple in construction and efficient in its wiping function.

Another object of the invention is to provide a wiper made of a tougher, though not abrasive material than those heretofore used, the wiper causing no more wear on a printhead than prior wipers made of softer materials.

A further object of the invention is to provide a wiper for an ink jet printhead, the wiper being shaped such that ink wiped from the printhead tends to flow away from the printhead and the wiping surface of the wiper.

Still another object of the invention is to provide a wiper for an ink jet printer, the wiper having diverging side surfaces which intersect a flat top surface at acute angles to form wiping edges.

Another object of the invention is to provide a wiper for the nozzle surface of an ink jet printhead and a blotter for absorbing from the wiper ink which has been wiped from the nozzle surface. The blotter may be provided on a slot in the nozzle surface or may be mounted to move with the wiper.

The above-stated objects of the invention are obtained by providing a wiper comprising a monolithic body having a mounting portion for movably mounting the wiper for movement into and out of the path of travel of the printhead, and a head portion including a wiper portion supported on a generally rectangular beam portion, the head portion having a flat top surface and side surfaces which diverge from the beam portion to intersect the top surface at acute angles thereby forming parallel wiping edges. A hole extends through the beam portion in a direction parallel to the direction of printhead travel, thus increasing the flexibility of the head portion. The wiper is preferably made of a thermoplastic polyester based polyurethane having a durometer hardness of about 85 Shore A.

Other objects of the invention and the manner of making and using it will become obvious from the following description and the accompanying drawings.

DETAILED DESCRIPTION OF THE INVENTION

Figure 1:
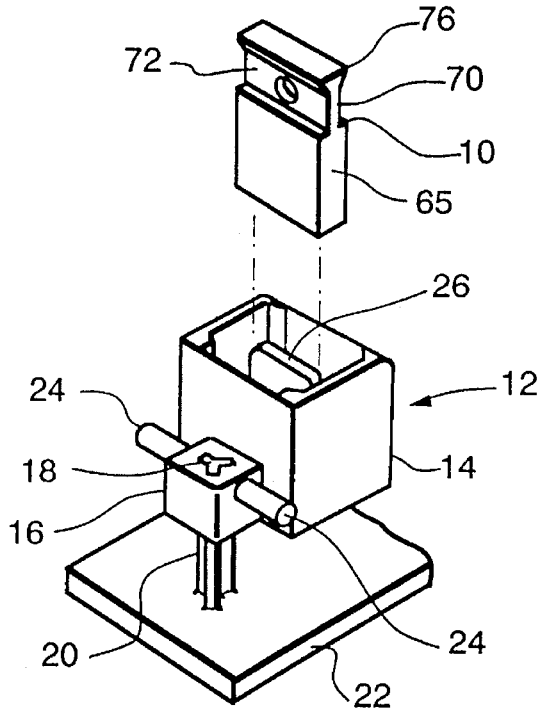
FIG. 1 is an exploded perspective view of the wiper and apparatus supporting the wiper for movement into, and out of, the path of printhead movement.

FIG. 1 illustrates a wiper 10, constructed according to the present invention, and a support means 12 for movably supporting the wiper. The support means 12 comprises a hollow, cube-like spit cup 14 having a support block 16 attached to one side. A hole 18 of irregular shape extends through the support block and a guide post 20 of the same irregular shape extends through the hole. The guide post 20 extends from a fixed frame member 22. Two pins 24 project from the sides of the support block 16. A force is applied to pin 24 as subsequently described to raise or lower spit cup 14. A mounting beam 26 extends upwardly from the bottom of spit cup 14 and the wiper 10 is mounted on beam 26 so that the wiper moves with the spit cup.

Figure 2:
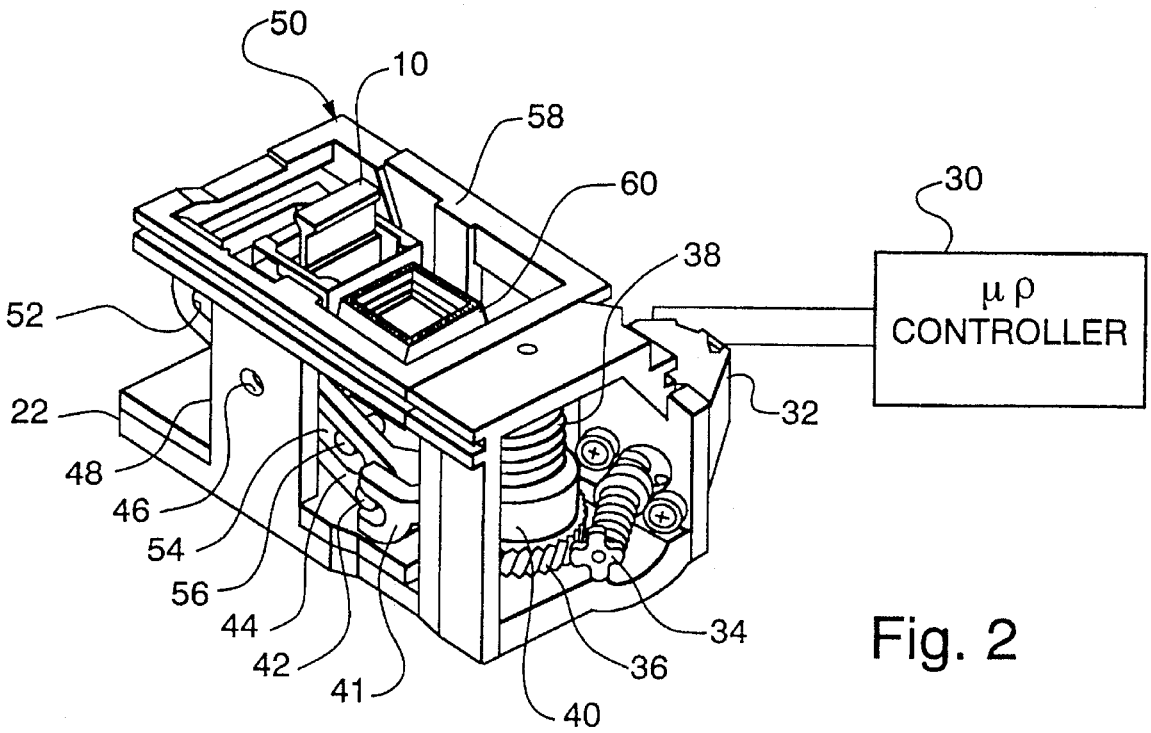
FIG. 2 is a perspective view of a maintenance station in which the wiper is mounted.

FIG. 2 shows a modular printhead maintenance station as disclosed and claimed in the above-referenced concurrently filed application. The maintenance station includes the wiper 10 and a cap 60 for capping the printhead when it is not in use. A controller 30 applies voltage pulses of a first or a second polarity to a DC motor 32 having a worm gear 34 mounted on its shaft. The worm gear drives a helical gear 36 that is interlocked with a power screw 38. A threaded nut 40 is mounted on the power screw and has two forked arms 41 for engaging pins 42 provided on a rocker element 44. The rocker element 44 is pivotally supported in holes 46 provided in side members 48 of a frame 50. The rocker element 44 has two pairs of slots 52, 54, the slots of a pair being located in opposing side walls of the rocker element. Two pins 56 ride in slot 54 to move the cap 26 vertically on a post similar to post 20 of FIG. 1. The pins 24 of FIG. 1 extend into the slots 52.

Briefly, when motor 32 is energized, worm gear 34 rotates helical gear 36 thereby rotating power screw 38. As screw 38 rotates, the nut 40 moves up or down depending on the direction in which the motor 32 is energized. The arms 41 on the nut apply force to pins 42 to pivot rocker element 44 about the axis of holes 46. In FIG. 1, the rocker element applies a force to pins 24 to thus raise or lower the spit cup 14 and the wiper 10.

The maintenance station and the printhead are disposed on opposite sides of a plane P (FIG. 5) in which a record is fed past the printhead. The motor 32 moves the rocker element between three operative positions: a first position where the wiper 10 extends about 2 mm above the path P1 traversed by the nozzle surface 102 of a printhead 96 so that the wiper is bent over and wipes the surface 102 as the printhead is moved past the wiper; a second position where the cap 26 presses against nozzle surface 102; and a third position where the cap and wiper are withdrawn from the printhead below the top surface 58 of the maintenance station frame element 50. As explained in the above-referenced application, the maintenance station is mounted such that surface 58 is coplanar with a frame member which defines the lower extent of the record feed path thereby permitting the maintenance station to be positioned directly under the record feed path or to one side and below the plane of the record feed path.

Figure 3:
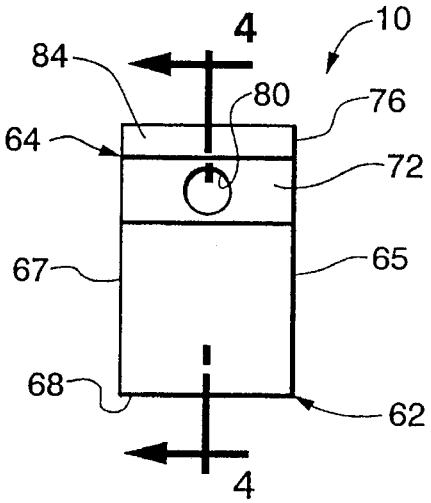
FIG. 3 is a side view of the wiper looking in the direction of printhead travel.
Figure 4:
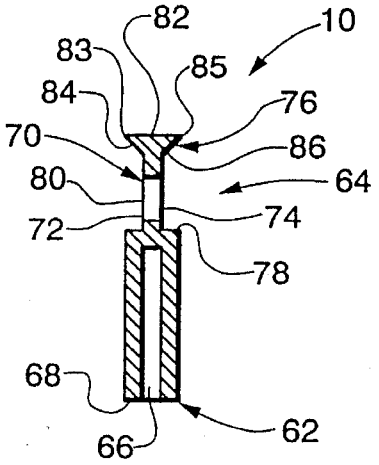
FIG. 4 is a section view taken along the line 4—4 of FIG. 3.

Referring now to FIGS. 1, 3 and 4, the wiper element 10 is a monolithic body having a mounting portion 62 and a head portion 64. The wiper is made from Texin 480-A available from Miles, Inc. or from another material having similar properties of hardness, abrasion resistance, elasticity, and chemical resistance. Texin 480-A is a thermoplastic polyester based polyurethane having a durometer of approximately hardness of 85 Shore A. A Taber abrasion test (ASTM method C-501) on this material gives a 20 mg loss in a test run for 1000 cycles using an H-18 wheel with a 1000 gram load.

The ends of the mounting portion 62 and head portion 64 are coplanar and form flat parallel opposing end surfaces 65, 67 extending from the top of the wiper to its bottom.

Mounting portion 62 is a rectangular body having a slot 66 centrally located in a bottom surface 68 and extending upwardly toward head portion 64. The slot 66 is sized and shaped to receive the mounting beam 26 (FIG. 1) as the wiper is mounted on the spit cup 14.

The head portion 64 comprises a beam portion 70 (FIG. 1) and a wiper portion 76. Beam portion 70 is rectangular and has parallel side surfaces 72, 74. The bottom of the beam portion 70 joins the mounting portion 62 at the top surface 78 of the mounting portion. A hole 80 extends through the beam portion between surfaces 72 and 74. The hole 80 makes the beam portion more flexible.

The wiper portion 76 has a top surface 82 and is integrally joined at its bottom to the top of beam portion 70. Two side surfaces 84 and 86 extend between top surface 82 and the side surfaces 72, 74, respectively, of beam portion 70. The side surfaces 84 and 86 diverge from each other in the direction of top surface 82 so as to intersect the surface 82 at acute angles forming wiping edges 83, 85. That is, the angles between surface 82 and surface 84, and surface 82 and surface 86 are acute angles. The angles should be as small as possible consonant with the material used and the limitations of the process for molding the material. In a practical embodiment using Texin 480-A as the wiper material, the angles may be about 60°. This provides improved wiping as subsequently described.

In a typical embodiment the wiper 10 measures 15.97 mm between top surface 82 and bottom surface 68 and 9.5 mm between the end surfaces 65, 67. The walls of mounting portion 62 surrounding slot 66 are 1 mm thick. The beam portion 70 is 1 mm thick measured between surfaces 72, 74 and 3.74 mm high. Surface 82 measures 3 mm between its intersections with surfaces 84, 86. The wiper portion 76 measures 1.73 mm between surface 82 and the top of beam portion 70. The hole 80 is 2.5 mm in diameter. The foregoing dimensions are given by way of example only. It is preferred that the dimension of the top surface 82 be such that when the wiper is moved normal to, and brought into contact with the nozzle surface 102 of a stationary printhead, the surface 82 will simultaneously cover all of the nozzles. This facilitates a "purge" operation as subsequently described.

Figure 5D:
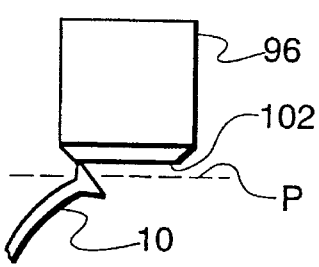
FIGS. 5A–5G are schematic representations of the positions of the wiper and printhead during wiping sequences.
Figure 5C:
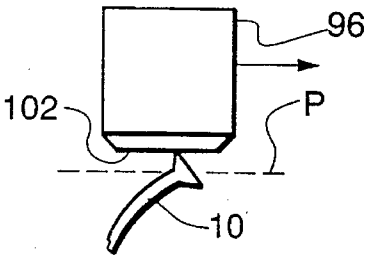
Figure 5B:
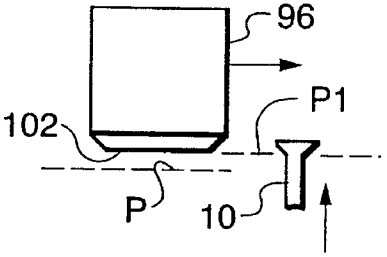
Figure 5A:
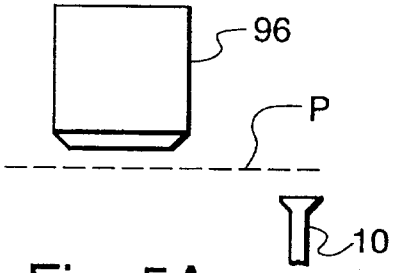

Movement of the wiper 10 during a wiping cycle may vary depending on the structure of the printer in which it is used. FIGS. 5A–C and E illustrate a preferred wiping sequence. In FIG. 5A, a printhead 96 is positioned at one side of the wiper 10 and the wiper is below a plane P in which a record is fed. The printhead drive is energized to move the printhead to the right and the drive motor 32 (FIG. 2) is energized to raise the wiper above a plane P1 traversed by the nozzle surface 102. This is illustrated in FIG. 5B. As the printhead continues its motion to the right (FIG. 5C) the wiper wipes the nozzle surface. The printhead moves to the right until the wiper 10 is free of the surface 102 at which time the printhead is stopped (FIG. 5E) and the wiper 10 lowered below plane P.

Figure 5E:
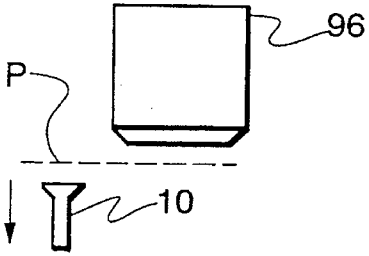
Figure 5F:
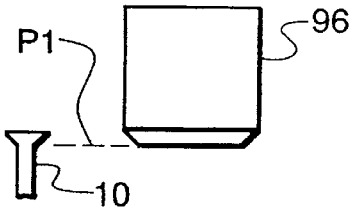
Figure 5G:
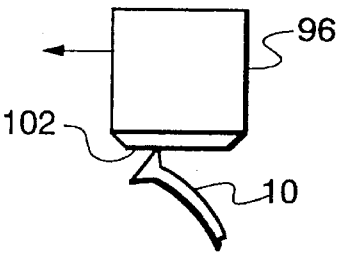

One pass of the printhead over the wiper is generally sufficient to clean the nozzle surface 102. However, if two or more passes are desired the wiper is not lowered as illustrated in FIG. 5E. The printhead may be stopped after it has cleared the wiper 10 so that the wiper may spring back to an upright position as shown in FIG. 5F with the upper portion of the wiper extending above plane P1. With the wiper still raised, the printhead 96 is moved to the left (FIG. 5G) so that the wiper again wipes the nozzle surface 102. When the printhead clears the wiper, the wiper is lowered so that the printhead and wiper are again in the position illustrated in FIG. 5A.

In some printers, space constraints limit movement of the printhead to the right (as viewed in FIGS. 5A–5G) far enough for the printhead to move completely past the wiper. A slightly different sequence of movement of the wiper is required in this case. A wiping sequence begins as previously described, the printhead being moved to the right as the wiper is raised (FIG. 5B) so that the wiper wipes the surface 102 (FIG. 5C). However, movement of the printhead stops (FIG. 5D) after the region of the surface 102 in which the nozzles are located has been wiped, but before the printhead is free of the wiper. The wiper is then lowered (FIG. 5E) so that it springs back to an upright position. If a second wipe is desired, the wiper 10 is again raised (not illustrated) as the printhead is moved to the left.

Figure 10A:
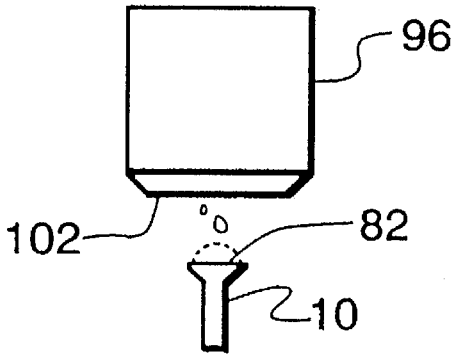
FIGS. 10A–10B schematically illustrate blotting to flush the nozzles of a printhead.
Figure 10B:
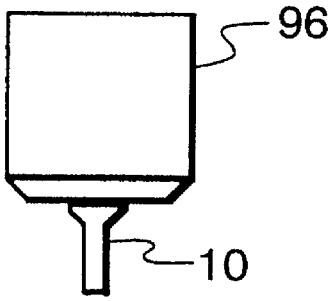

The wiper may also be used in a "purge" sequence (FIG. 10) to remove dried ink from the nozzles. This sequence is normally used only if printing quality has deteriorated and it is suspected that the nozzles are clogged. In a purge sequence, the printhead 96 is positioned so that the region of surface 102 in which the nozzles are located is directly over the wiper 10. At this time the wiper is still positioned below the plane P. Next, the nozzles are actuated (FIG. 10A) to eject ink onto the upper surface 82 of the wiper. The wiper is then raised. As previously explained, the wiper 10 moves along a line normal to the plane of nozzle surface 102. The wiper surface 82 is thus always in a plane parallel to the plane of surface 102. Since the wiper surface 82 has an area large enough to simultaneously cover all of the nozzles, the wet ink on the surface 82 is lightly forced into the nozzles as the wiper is raised (FIG. 10B). The wet ink aids in dissolving dried ink in the nozzle orifices.

After the wiper has been raised into contact with the nozzle surface 102, the printhead may be wiped using any one of the wiping sequences described above.

While the wiper described above works quite well without a blotter, a blotter may be provided for absorbing ink wiped from the nozzle surface 102. Many printheads have a slot 110 (FIG. 6, which is a view of the underside of the printhead) in the surface 102, the slot being located at one side of the region 112 in which the nozzles and electrical connections thereto are located. In printers having a printhead of this type the blotter 114 may comprise a pad of ink-absorbing material such as felt or cotton placed in the slot and having an exposed surface substantially coplanar with the nozzle surface 102.

In cases where the printhead does not have a slot 110, the blotter may comprise either one or two ink-absorbing pads 114'. Two pads 114' are desirable in those cases where the wiping sequence involves moving the printhead in both directions. If wiping is to take place in one direction only then only one pad may be used.

Figure 7B:
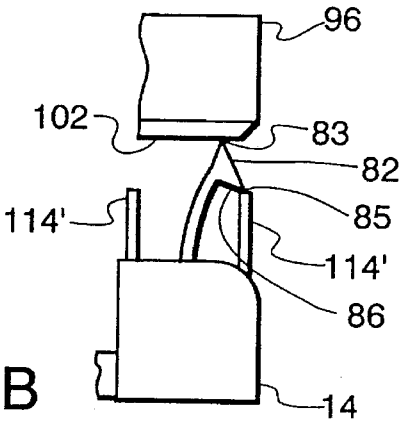
FIG. 7B shows a blotter of the type illustrated in FIG. 7A blotting a wiper as the wiper wipes a printhead.
Figure 7A:
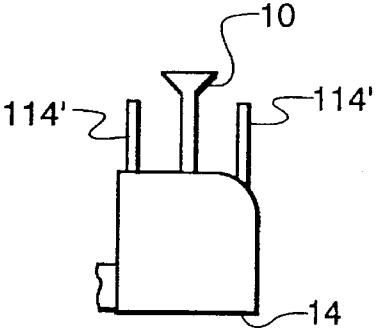
FIG. 7A shows a second embodiment of a blotter.

FIG. 7A shows the wiper 10 when it is lowered so that it does not contact a printhead. At this time the wiper 10 is upright and equally spaced from the blotters 114. When the wiper is raised and the printhead is moved to the right, the wiper is deflected such that the wiping edge 85 and a portion of the wiper surface 86 contacts one of the blotters 114' so that ink is transferred from the wiper to the blotter. When wiping with the printhead moving from right to left, the other blotter 114' blots the other wiping edge 83.

Figure 6:
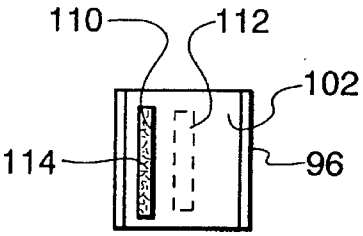
FIG. 6 illustrates the placement of a blotter in a printhead nozzle surface.

The blotter arrangement shown in FIG. 6 is preferred because it permits blotting a wiping edge immediately after the wiping edge traverses the nozzle region 112. In the arrangement shown in FIGS. 7A and 7B, blotting of one wiping edge takes place while the other wiping edge is wiping. There is thus a longer interval for ink to dry on the wiper before blotting takes place.

Figure 8:
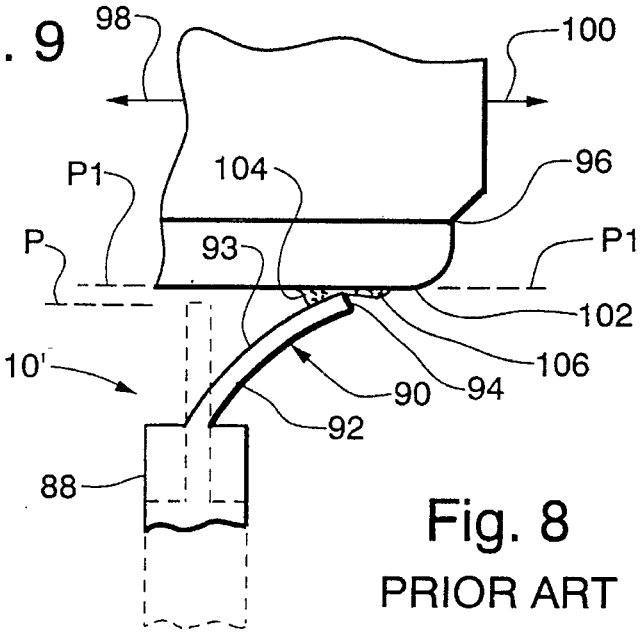
Fig. 8 PRIOR ART
FIG. 8 schematically illustrates the wiping of a printhead by a prior art wiper.

Referring now to FIG. 8, a typical wiper 10' of the prior art comprises a mounting portion or base 88 having a wiping beam 90 extending upwardly therefrom, the wiping beam being essentially rectangular so that opposing sides 92, 93 form a right angle with the top surface 94. A printhead 96 is provided with means, represented by arrows 98, 100, for moving it back and forth transverse to the direction of record feed. The wiper 10' is disposed at one side of the plane P of record feed. In one prior art printer the wiper 10' is mounted for movement between a first position (shown in broken lines) where the wiper surface 94 is below the plane P1 transversed by the surface 102 in which the nozzles are located, and a second position where the wiper surface 94 is above the plane P1.

The wiper 10' is used as follows. When wiping is to take place, the wiper is moved upwardly. The printhead 96 is then moved past the wiper in one direction until the printhead 96 passes or is clear of the wiper. The printhead is then moved in the opposite direction until the printhead is again clear of the wiper. On each pass of the printhead past the wiper from left to right, the wiping edge formed by the intersection of surface 94 with surface 93 wipes accumulated dust and ink from the surface 102 and on each pass of the printhead past the wiper from right to left, the wiping edge formed by the intersection of surface 94 with surface 92 performs the wiping.

FIG. 8 shows the position of the wiper as the printhead 96 is moving from left to right. As accumulated ink and dust is wiped from the surface 102 it is pushed along the surface 102, being in effect trapped so as to accumulate between the surface 102 and the side surface 93 of the wiper as indicated at 104. Because of the flexibility of the wiper and the viscous character of the ink the wiper tends to ride onto the accumulation thereby leaving a thin film of ink (and dust) on the surface 102 as indicated at 106. Because of its surface tension the ink quickly reforms into pools on the surface 102.

Over its life, the wiper 10' tends to wear at the wiping edges, and as wearing occurs there is a greater tendency for the wiper to ride onto the accumulation and thus leave the thin ink layer 106 after the printhead moves past the wiper.

Figure 9:
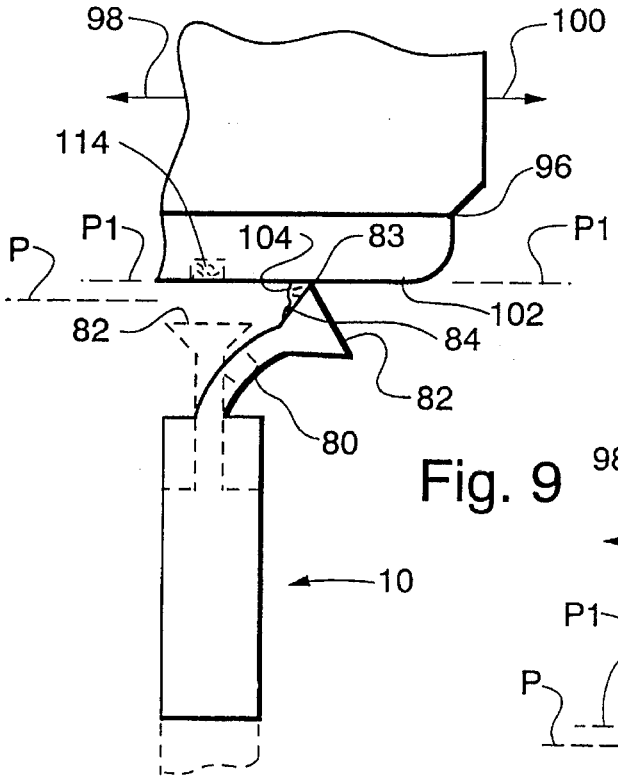
FIG. 9 schematically illustrates the wiping of a printhead by the new wiper.

FIG. 9 illustrates the wiping action of a wiper constructed according to the present invention. Prior to a wiping operation the wiper 10 occupies the position shown in broken lines with the top surface 82 of the wiper being below the plane P in which record sheets are fed and parallel to the plane P1 in which the nozzles move. FIG. 9 illustrates an instant in the wiping cycle in which the printhead is moving from left to right so that the wiping edge 83 wipes the nozzle surface 102. As with the prior art device of FIG. 8, the ink and other foreign matter wiped from the surface 102 gathers in front of the side surface of the wiper. However, in FIG. 9, because of the acute angle formed between surfaces 82 and 84, rather than a right angle as exists between surfaces 94 and 93, the angle between surfaces 102 and 84 is greater than the angle between surfaces 102 and 93. This has two advantages. First, because the surface 84 is more nearly normal to surface 102 than surface 93 there is less tendency for the wiper to ride up onto any ink accumulation being gathered in front of it. Secondly, because surface 84 is more nearly vertical than the surface 93 in the region of ink accumulation, the ink tends to run more freely down the side of the wiper, thus preventing any large ink accumulation which would push the wiper away from surface 102. As a result very little ink remains on surface 102 after the wiper edge moves over it.

Almost immediately after the wiping edge 83 clears the region of the nozzles, the wiping edge contacts the blotter 114 carried by the printhead and ink wiped from the nozzle surface 102 is transferred from the wiper to the blotter.

While several embodiments of the invention have been described in specific detail, it will be understood that various modifications and substitutions may be made in the described embodiments without departing from the spirit and scope of the invention as defined by the appended claims.

We claim:

1. A printhead wiper for wiping a surface of an ink jet printhead when the wiper is moved by a mounting beam into a path traversed by said printhead, said wiper comprising a flexible monolithic body, said body having a mounting portion for mounting said wiper, a wiper portion, and a beam portion, said beam portion having first and second parallel side surfaces, said wiper portion having a flat upper surface and first and second opposing side surfaces which diverge from said first and second parallel side surfaces, respectively, and intersect said flat upper surface at acute angles to form first and second parallel wiping edges, said mounting portion being joined at a first end to said beam portion and having a second end which terminates at a bottom surface, said mounting portion having a slot centered in said bottom surface and extending into the interior of said mounting portion toward said beam portion, said slot being sized and shaped to receive and surround a mounting beam, said mounting portion having a thickness greater than a distance between said first and second parallel side surfaces of said beam portion whereby said wiper flexes primarily in said beam portion, said beam portion being centered with respect to said first end of said mounting portion whereby said wiper wipes said surface of said printhead with equal force regardless of the direction of movement of said printhead along said path.

2. A printhead wiper as claimed in claim 1 wherein a hole extends through said beam portion between the first and second parallel side surfaces to increase flexibility of said beam portion, said hole being spaced from said mounting portion and said wiper portion.

3. A printhead wiper as claimed in claim 1 wherein said mounting portion includes two side surfaces equidistantly offset from, but extending parallel to, the first and second parallel side surfaces of said beam portion, wherein said thickness of said mounting portion is defined by a distance between said two side surfaces.

4. A printhead wiper as claimed in claim 1 in combination with a printhead having ink jet nozzles, all of the nozzles of said printhead being disposed within a nozzle region, said flat upper surface lying in a plane parallel to a plane in which said nozzle region lies, said flat upper surface having dimensions at least as great as dimensions of said nozzle region whereby said flat upper surface may simultaneously contact all of the nozzles of said printhead when the wiper is moved normal, and into contact with, the printhead surface.

5. A printhead wiper as claimed in claim 1 wherein said acute angles are about 60 degrees.

6. A printhead wiper as claimed in claim 1 wherein said flexible monolithic body has two parallel planar end surfaces extending from said flat upper surface to said bottom surface of said mounting portion, said end surfaces defining ends of said wiper portion, said beam portion and said mounting portion.

* * * * *